US011818812B2

(12) United States Patent
Rothwell

(10) Patent No.: US 11,818,812 B2
(45) **Date of Patent: *Nov. 14, 2023**

(54) HEATING ELEMENT AND METHOD OF ANALYZING

(71) Applicant: NICOVENTURES HOLDINGS LIMITED, London (GB)

(72) Inventor: Howard Rothwell, London (GB)

(73) Assignee: Nicoventures Trading Limited, London (GB)

( * ) Notice: Subject to any disclaimer, the term of this patent is extended or adjusted under 35 U.S.C. 154(b) by 585 days.

This patent is subject to a terminal disclaimer.

(21) Appl. No.: 16/482,429

(22) PCT Filed: Jan. 30, 2018

(86) PCT No.: PCT/GB2018/050253
§ 371 (c)(1),
(2) Date: Jul. 31, 2019

(87) PCT Pub. No.: WO2018/142114
PCT Pub. Date: Aug. 9, 2018

(65) Prior Publication Data

US 2020/0000150 A1 Jan. 2, 2020

(30) Foreign Application Priority Data

Feb. 1, 2017 (GB) ..... 1701634

(51) Int. Cl.
*H05B 3/22* (2006.01)
*H05B 3/12* (2006.01)
(Continued)

(52) U.S. Cl.
CPC ..... *H05B 3/22* (2013.01); *A24F 40/46* (2020.01); *H05B 3/12* (2013.01); *H05B 3/26* (2013.01);
(Continued)

(58) Field of Classification Search
CPC ... H05B 3/22; H05B 3/12; H05B 3/26; H05B 2203/017; H05B 2203/021; A24F 40/46;
(Continued)

(56) References Cited

U.S. PATENT DOCUMENTS 4,099,607 A 7/1978 Brennan
4,289,406 A 9/1981 Maddox
(Continued)

FOREIGN PATENT DOCUMENTS

CA 2956377 A1 * 3/2016 ..... A24B 15/16
CN 101347477 A 1/2009
(Continued)

OTHER PUBLICATIONS

Bekaert, basic Formulas for Bekipor® medium, Jul. 2, 2003.
(Continued)

*Primary Examiner* — Shawntina T Fuqua
(74) *Attorney, Agent, or Firm* — Patterson Thuente P.A.

(57) ABSTRACT

A method for obtaining a heating element for an electronic vapor provision system includes providing a sheet of electrically conductive porous material, measuring amounts of light transmitted through at least two locations on the sheet to obtain a set of optical transmission values including a maximum value and a minimum value, comparing a difference value calculated from the maximum and minimum values with a predetermined acceptable variation in optical transmission, and selecting the sheet for use as a heating element if the difference value falls within the acceptable variation.

12 Claims, 4 Drawing Sheets

(51) Int. Cl.
*H05B 3/26* (2006.01)
*A24F 40/46* (2020.01)
*A24F 40/10* (2020.01)

(52) U.S. Cl.
CPC ..... *A24F 40/10* (2020.01); *H05B 2203/017* (2013.01); *H05B 2203/021* (2013.01)

(58) Field of Classification Search
CPC ..... A24F 40/10; A24F 40/50; A24F 47/008; G01N 15/088; G01N 21/5907; G01N 21/5911; G01N 21/59; G01N 2015/0846; G01N 2021/5915
See application file for complete search history.

(56) References Cited

U.S. PATENT DOCUMENTS

| | | | | |
|---|---|---|---|---|
| 4,575,251 | A | 3/1986 | Hotta | |
| 9,182,381 | B2 | 11/2015 | Mitchell et al. | |
| 10,334,885 | B2 | 7/2019 | Baker et al. | |
| 10,897,931 | B2 | 1/2021 | Azzopardi et al. | |
| 2001/0029436 | A1 | 10/2001 | Kogaku | |
| 2005/0264829 | A1 | 12/2005 | Schroeder | |
| 2007/0292311 | A1 | 12/2007 | Daisuke | |
| 2009/0325324 | A1 | 12/2009 | Masaki | |
| 2010/0220019 | A1 | 9/2010 | Boote | |
| 2013/0003063 | A1 | 1/2013 | Headley | |
| 2014/0238424 | A1 | 8/2014 | Macko et al. | |
| 2015/0059780 | A1* | 3/2015 | Davis | A24F 40/44 131/328 |
| 2015/0090279 | A1 | 4/2015 | Chen | |
| 2015/0209530 | A1 | 7/2015 | White | |
| 2017/0266087 | A1 | 9/2017 | Bouarfa et al. | |
| 2020/0000149 | A1 | 1/2020 | Rothwell | |
| 2022/0117314 | A1* | 4/2022 | Daugherty | A24F 40/53 |

FOREIGN PATENT DOCUMENTS

| | | | | | |
|---|---|---|---|---|---|
| CN | 201194000 | | | 2/2009 | |
| CN | 101979011 | A | | 2/2011 | |
| CN | 102125028 | A | | 7/2011 | |
| CN | 202204753 | | | 4/2012 | |
| CN | 102879312 | | | 1/2013 | |
| CN | 102879312 | A | * | 1/2013 | |
| CN | 103859605 | | | 6/2014 | |
| CN | 105394816 | A | | 3/2016 | |
| EP | 1151751 | A1 | | 11/2001 | |
| EP | 3158882 | | | 4/2017 | |
| GB | 2149092 | | | 6/1985 | |
| GB | 2416836 | | | 2/2006 | |
| JP | S53109933 | A | | 9/1978 | |
| JP | 60049561 | | | 3/1985 | |
| JP | 60050935 | | | 3/1985 | |
| JP | 60082660 | | | 5/1985 | |
| JP | H0650873 | A | | 2/1994 | |
| JP | 9166561 | | | 6/1997 | |
| JP | 2005512586 | A | | 5/2005 | |
| JP | 2007008443 | A | | 1/2007 | |
| JP | 2009079978 | A | | 4/2009 | |
| JP | 2010110918 | | | 5/2010 | |
| JP | 2014218103 | A | | 11/2014 | |
| JP | 2017505122 | A | | 2/2017 | |
| RU | 2015100878 | A | | 9/2016 | |
| TW | 200812421 | A | * | 3/2008 | H05B 3/347 |
| WO | WO-2012019372 | A1 | | 2/2012 | |
| WO | WO-2013006415 | A2 | | 1/2013 | |
| WO | 2015114328 | | * | 8/2015 | |
| WO | WO 2015114328 | | | 8/2015 | |
| WO | WO-2015117701 | A1 | | 8/2015 | |
| WO | WO 2016005533 | | | 1/2016 | |
| WO | WO 2016023965 | | | 2/2016 | |
| WO | WO 2016108694 | | | 7/2016 | |

OTHER PUBLICATIONS

Bekaert, Bekipor® porous metal fibre media, 2006.
Bekaert, Bekipor® web series, Stainless steel metal fiber web with high porosity adapted to your needs, Feb. 2012.
International Search Report and Written Opinion, Application No. PCT/GB2018/050253, dated May 2, 2018, 13 pages.
International Report on Patentability, Application No. PCT/GB2018/050253, mailed, dated Apr. 15, 2019, 18 pages.
Application and File History for U.S. Appl. No. 16/482,423, filed Jul. 31, 2019, inventor Rothwell.
Database WPI Week 197844 Thomson Scientific, London, GB; AN 1978-78926A XP002113399, 2017, 2 pages.
International Preliminary Report on Patentability for Application No. PCT/GB/2018/050254, dated Aug. 15, 2019, 8 pages.
International Preliminary Report on Patentability for Application No. PCT/GB2018/053140, dated Oct. 7, 2019 13 pages.
International Search Report and Written Opinion for Application No. PCT/GB2018/050254, dated Apr. 26, 2018, 13 pages.
International Search Report and Written Opinion for Application No. PCT/GB2018/053140, dated Feb. 6, 2019, 75 pages.
Office Action dated Apr. 14, 2020 for Russian Application No. RU2019124120, 15 pages.
Office action for Canadian Application No. 3051320, dated Jan. 8, 2021, 6 pages.
Office action for Canadian Application No. 3051322, dated Jan. 8, 2021, 5 pages.
Search Report for Japanese Application No. 2019-538342, dated Sep. 18, 2020, 21 pages.
Search Report for Japanese Application No. 2019-538417, dated Sep. 18, 2020, 18 pages.

* cited by examiner

HEATING ELEMENT AND METHOD OF ANALYZING

PRIORITY CLAIM

The present application is a National Phase entry of PCT Application No. PCT/GB2018/050253, filed Jan. 30, 2018, which claims priority from GB Patent Application No. 1701634.6, filed Feb. 1, 2017, which is hereby fully incorporated herein by reference.

TECHNICAL FIELD

The present disclosure relates to a heating element such as for use in an electronic vapor provision system or device, for example an electronic cigarette, and also to a method for analyzing such heating elements.

BACKGROUND

Aerosol or vapor provision devices such as e-cigarettes generally comprise a reservoir of a source liquid containing a formulation, typically including nicotine, from which an aerosol is generated, such as through vaporization or other means. To achieve vaporization, a vapor provision system may include a heating element coupled to a portion of the source liquid from the reservoir. The temperature of the heating element is raised, such as by passing an electrical current from a battery through the heating element, and source liquid in contact with the heating element is vaporized. For example, a user may inhale on the system to activate the heating element and vaporize a small amount of the source liquid, which is thus converted to an aerosol for inhalation by the user.

Operation of a heating element of this type relies on the phenomenon of resistive heating, where the electrical resistance of the heating element produces a temperature rise when a voltage is applied across the heating element to cause current to flow through it. Heating elements for e-cigarettes often comprise a conductive metal wire, formed into a shape such as a coil. A porous element such as a fibrous wick is arranged in contact with the heating element (for example, the heating element is a wire wound around a rod-shaped wick) and also in contact with source liquid in the reservoir. Capillary action or wicking in the porous element carries liquid from the reservoir to the heater for vaporization.

It has been proposed that the heating and the wicking be combined into a single component. For example, if the heating element is fabricated from a sheet of electrically conductive porous material such as a metal mesh or grill, apertures in the porous structure provide a capillary action to draw liquid from the reservoir directly into the heating element for vaporization by heating when a current flows through the material.

The structure of a conductive mesh may produce irregular resistive properties, leading to uneven heating which may impact vapor production.

Accordingly, characterization of conductive porous sheet material according to its suitability for use as a resistive heating element is of interest.

SUMMARY

According to a first aspect of certain embodiments described herein, there is provided a method for obtaining a heating element for an electronic vapor provision system, the method comprising: providing a sheet of electrically conductive porous material; measuring amounts of light transmitted through at least two locations on the sheet to obtain a set of optical transmission values including a maximum value and a minimum value; comparing a difference value calculated from the maximum and minimum values with a predetermined acceptable variation in optical transmission; and selecting the sheet for use as a heating element if the difference value falls within the acceptable variation.

For example, the difference value may be the difference between the maximum value and the minimum value, and the predetermined acceptable variation is a largest acceptable range in the measured optical transmission values which the difference value should not exceed. The difference value may be expressed as a percentage, proportion or fraction, and the largest acceptable range is defined as a percentage, proportion or fraction of the maximum value or the minimum value of optical transmission measured for the sheet. The largest acceptable range may be not greater than 10% of the maximum value, for example.

In another example, the difference value may be at least one of a difference between the maximum value or the minimum value and an average value of the set of optical transmission values, and the predetermined acceptable variation is a largest acceptable deviation of the maximum value and/or the minimum value from the average value which the difference value should not exceed. The difference value may be expressed as a percentage, proportion or fraction, and the largest acceptable deviation is defined as a percentage, proportion or fraction of the average value of the set of optical transmission values measured for the sheet. The largest acceptable deviation may be not greater than 5% of the average value, for example.

In another example, the difference value is the percentage, proportion or fraction of the maximum value represented by the minimum value, and the predetermined acceptable variation is a minimum acceptable value of this percentage. The minimum acceptable value may be at least 90% of the maximum value, for example.

The electrically conductive porous material may comprise a mesh of metal fibers, such as a mesh of sintered stainless steel fibers.

The method may further comprise determining the acceptable variation in optical transmission using a known relationship between optical transmission and electrical resistance for the electrically conductive porous material.

According to a second aspect of certain embodiments described herein, there is provided a heating element for an electronic vapor provision system or a blank for forming a heating element for an electronic vapor provision system, comprising a sheet of electrically conductive porous material having an optical transmission profile in which a minimum value of optical transmission is at least 90% of a maximum value of optical transmission.

According to a third aspect of certain embodiments described herein, there is provided a heating element for an electronic vapor provision system or a blank for forming a heating element for an electronic vapor provision system, comprising a sheet of electrically conductive porous material having an optical transmission profile in which a difference between a minimum and a maximum value of optical transmission is not more than 10% of the maximum value.

According to a fourth aspect of certain embodiments described herein, there is provided a heating element for an electronic vapor provision system or a blank for forming a heating element for an electronic vapor provision system, comprising a sheet of electrically conductive porous material having an optical transmission profile in which either or both of a maximum and minimum value of optical transmission differs from an average value of optical transmission by not more than 5%.

The electrically conductive porous material may comprise a mesh of metal fibers, for example a mesh of sintered stainless steel fibers.

These and further aspects of certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, a heating element and associated method may be provided in accordance with approaches described herein which includes any one or more of the various features described below as appropriate.

BRIEF DESCRIPTION OF THE DRAWINGS

Various embodiments will now be described in detail by way of example only with reference to the accompanying drawings in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) heating elements suitable for use in electronic aerosol or vapor provision systems, such as e-cigarettes. Throughout the following description the terms "e-cigarette" and "electronic cigarette" may sometimes be used; however, it will be appreciated these terms may be used interchangeably with aerosol (vapor) provision system or device. Similarly, "aerosol" may be used interchangeably with "vapor."

One type of heating element that may be utilized in an atomizing portion of an electronic cigarette (a part configured to generate vapor from a source liquid) combines the functions of heating and liquid delivery, by being both electrically conductive (resistive) and porous. An example of a suitable material for this is an electrically conductive material such as a metal or metal alloy formed into a fine mesh, web, grill or similar configuration having a sheet format, i.e. a planar shape with a thickness many times smaller than its length or breadth. The mesh may be formed from metal wires or fibers which are woven together, or alternatively aggregated into a non-woven structure. For example, fibers may be aggregated by sintering, in which heat and/or pressure are applied to a collection of metal fibers to compact them into a single mass.

These structures can give appropriately sized voids and interstices between the metal fibers to provide a capillary force for wicking liquid. The material is therefore porous. Also, the metal is electrically conductive and therefore suitable for resistive heating, whereby electrical current flowing through a material with electrical resistance generates heat. Structures of this type are not limited to metals, however; other conductive materials may be formed into fibers and made into mesh, grill or web structures having porosity and resistivity. Examples include ceramic materials, which may or may not be doped with substances intended to tailor the physical properties of the mesh.

Figure 1:
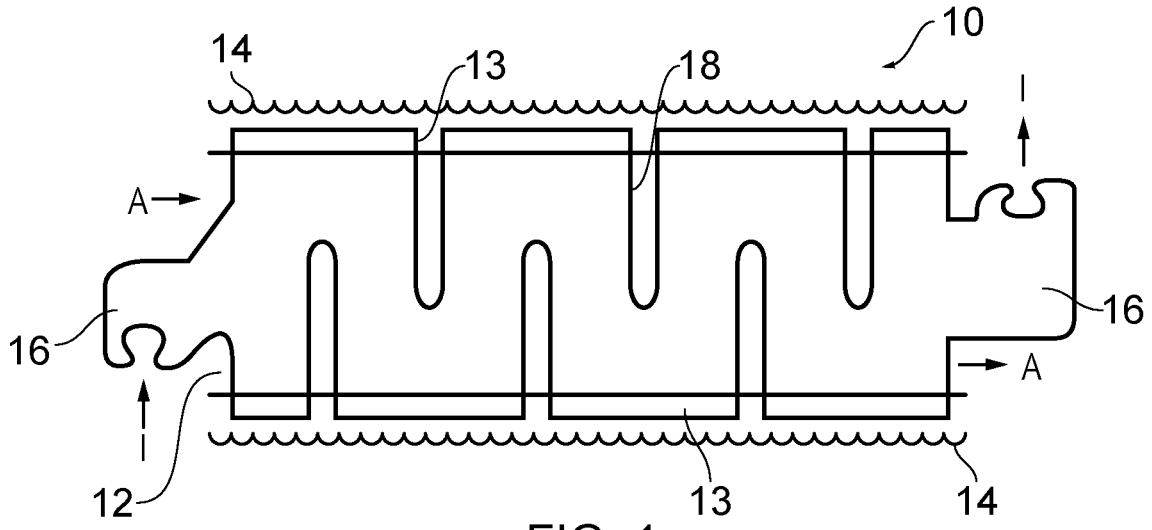
FIG. 1 shows a schematic plan view of an example electrical heating element to which embodiments can apply.

FIG. 1 shows a plan view of an example heating element of this format. The heating element 10 is generally rectangular, with two long sides and two short sides, and planar in that its thickness into the plane of the page is many times smaller than its length or its width in the plane of the page. In use within an e-cigarette, it is mounted across an air flow channel 12 so that air travelling along the channel 12 flows over the surface of the element 10 to collect vapor. The thickness of the heating element 10 is orthogonal to the direction of air flow, shown by the arrows A. The heating element 10 is mounted such that its edge portions 13 along the long sides extends through a wall or walls defining the airflow channel 12, and into a reservoir of source liquid 14 held in an annular space surrounding the airflow channel 12. Capillary action draws liquid 14 from the reservoir towards the central region of the heating element. At its short edges, the heating element 10 has shaped connector portions 16 which are connected to electrical leads or other conducting elements (not shown) configured to pass electrical current through the heating element 10 to generate the required resistive heating, indicated by the arrows I. The heating element 10 has a series of slots 18 along its long sides, orthogonal thereto. These act to modify the current flow path away from a straight path between the connector portions 18 since the current is forced to flow around the ends of the slots. This alters the current density in these areas to form regions of a higher temperature that can be beneficial in producing a desirable vaporization action.

The heating element 10 may be formed by stamping or cutting (such as laser cutting) the required shape from a larger sheet of porous material.

The present disclosure is not limited to heating elements of the size, shape and configuration of the FIG. 1 example, however, and is applicable widely to heating elements formed from planar porous conductive materials.

Heating elements of this type may be made from a conductive material which is a nonwoven sintered porous web structure comprising metal fibers, such as fibers of stainless steel. For example, the stainless steel may be AISI (American Iron and Steel Institute) 316L (corresponding to European standard 1.4404). The material's weight may be in the range of 100-300 g/m$^2$. Its porosity may be greater than 50%, or greater than 70%, where porosity is the volume of air per volume of the material, with a corresponding density less than 50% or less than 30%, where density is the volume of fibers per volume of the material. Thickness of the material may be in the range of 75-250 μm. A typical fiber diameter may be about 12 μm, and a typical mean pore size (size of the voids between the fibers) may be about 32 μm. An example of a material of this type is Bekipor® ST porous metal fiber media manufactured by NV Bekaert SA, Belgium, being a range of porous nonwoven fiber matrix materials made by sintering stainless steel fibers.

Again, the present disclosure is not limited to heating elements made from this material, and is applicable widely to heating elements made from planar porous conductive materials. Note also that while the material is described as planar, this refers to the relative dimensions of the sheet material and the heating elements (a thickness many times smaller than the length and/or width) but does not necessarily indicate flatness, in particular of the final heating element made from the material. A heating element may be flat but might alternatively be formed from sheet material into a non-flat shape such as curved, rippled, corrugated, ridged, formed into a tube or otherwise made concave and/or convex.

A consequence of manufacturing processes such as weaving and sintering to make woven or nonwoven porous web structures from conductive fibers is that the material may have an uneven density of fibers, giving an inhomogeneous structure and leading to uneven electrical resistivity across a sample of the material. Any irregular resistivity, i.e. localized regions with higher or lower resistivity than the average resistivity for a sample of the material, will produce a corresponding irregularity in resistive heating, in that higher resistance regions will become hotter than average and lower resistance regions will be cooler than average. For an application such as vaporization of source liquid in an electronic cigarette that relies on heating to a specified temperature (or range of temperatures for a tailored pattern of current density across a heating element) to produce a required level of vaporization, irregularities of resistance across a heating element can be undesirable. A homogeneous structure having consistent resistance may be more suitable. Completed electronic cigarette devices may fail product testing after manufacture if it is found that the heating element produces uneven heating not corresponding to a specified heating profile. Techniques for identifying in advance heating element material with appropriate resistive properties are therefore of interest, allowing unsuitable material to be rejected before it is incorporated into a complete device or component therefore. Also, characterization of the material via a property or properties that relate to its suitability for use in fabricating heating elements is also of interest.

The present disclosure utilizes a recognition that a homogeneous physical structure and corresponding homogenous resistance across a sample of porous conductive material can give rise to other homogenous properties that can be used to characterize a sample, for example as being more or less suitable for use as a heating element. In particular, optical transmission properties have been found to correlate to electrical resistance properties. Consequently, samples of porous conductive material with homogenous optical transmission, that is optical transmission with a low variability across the sample (such as falling within a small predetermined range), can be recognized as also having homogenous or near-homogeneous resistance.

It has been found that the optical transmission of a porous conductive web material is indicative of its electrical resistance. Optical transmission is the fraction or proportion of an incident light intensity which is transmitted through an object or part of an object. The web of conductive fibers comprises voids and apertures and is not solid, and hence allows some light to pass through, so its optical transmission can be measured. A denser web will transmit a lower fraction of incident light than a more open web. Also, a denser web contains more metal fibers and therefore has a lower resistance whereas conversely a more open web contains fewer metal fibers and has a correspondingly higher resistance. On combining these two properties, it has been found that there is a relationship between transmitted light intensity and electrical resistance, for samples of the same web material exposed to the same level and wavelength of incident light. Each sample has an optical transmission characteristic (amount of light it will transmit) and a value of electrical resistance, and these two properties are related. The optical transmission is proportional to the electrical resistance. For a predetermined and fixed illumination set-up, transmission is equivalent to the absolute amount of transmitted light, so the measured light intensity is also proportional to the electrical resistance. In the following, the terms "transmission" and "intensity" may be used interchangeably, except where a particular meaning is specified.

Optical transmission is proportional to electrical resistance, and each of these properties is applicable to the entirety of a sample of conductive sheet material (where averages values for the properties can be derived). Additionally, the properties can be considered on a smaller scale by considering how the properties vary across the sample. The variation arises owing to the fiber-based structure of the materials of interest, in that local fiber density may vary and not be consistent at all points within a sample. Consequently, both optical transmission and electrical resistance may show a variation across a sample, with the variations of the two properties being correlated owing to the proportional relationship. A large variation may indicate that a sample of material is not suitable for use in fabricating one or more electrical heating elements, because the resistance variation will produce uneven heating, with hot and cold spots being generated when current is passed. However, optical transmission variation may be more convenient to measure than the variation of resistance. Accordingly, the optical transmission characteristic of a sample of conductive porous sheet material may usefully be used to specify its suitability for use in fabricating heating elements for electronic vapor provision systems.

The variation of a physical property across a sample (being the difference between local values of that property) can be considered as a profile. For a planar sample, the property might be measured (or sampled, detected or recorded) at multiple (at least two) locations across the length and width of the sample so as to give a two-dimensional profile. The locations might be arranged as a regular array over the sample surface, or may be a random selection of locations scattered over the sample. Alternatively, a one-dimensional or linear profile might be obtained by measuring the property at a series of points along a line or path (which may or may not be straight) extending across the sample's length or width, where the points are regularly or irregularly spaced. A larger quantity of measurement locations will give a more detailed profile, but a smaller quantity of measurements can be obtained and processed more quickly and may adequately represent the sample's properties within the required precision of the fabrication process. Accordingly, a profile obtained by any of these techniques (or indeed other techniques that will be evident to the skilled person) may be used within embodiments of the present disclosure, where the profile of interest is a profile of optical transmission, representing a plurality of measurements of optical transmission obtained at locations over the surface of a sample of porous conductive material. In any case, the profile is a spatial profile representing the spatial variation of optical transmission.

For a given design of electrical heating element, a range of values of acceptable electrical resistance might be defined. For ease, an acceptable value may be defined as an average value, representative of resistance across the sample. However, a measured average value which is found to fall within the acceptable range may mask a large variation in the resistance profile over the sample, in that some positions might have a local resistance that deviates greatly from the acceptable value. Such a sample will generate patchy uneven heating, and therefore will likely be considered unsuitable for use as a heating element.

Therefore, for any resistivity specification, in addition to defining a required absolute value of resistance (which may or may not be an average value), one can define a variation or tolerance about the absolute value that represents a variation of local resistance values across the whole sample which can be tolerated in terms of requirements for even heating. For example, it is possible to define an acceptable amount of resistance above and below the required value, or a maximum acceptable difference between highest and lowest resistance values. The smaller the range of acceptable values, the more homogeneity is specified for a sample.

Using the proportionality between electrical resistance and optical transmission noted above and discussed further below, this requirement for homogenous resistance can be translated into a requirement for homogenous optical transmission (which represents the homogeneity of the physical structure of the sample material). The optical transmission profile of a sample indicates the degree of homogeneity in optical transmission, where the difference between highest and lowest values in the profile represents the variation in optical transmission, and a smaller difference indicates higher homogeneity (a more consistent physical structure).

Accordingly, embodiments of the disclosure define that a sample of planar conductive porous material has an optical transmission profile in which the lowest (minimum) value of optical transmission is at least 90% of the highest (maximum) value of optical transmission. Instead, one may define that the range of the optical transmission profile, being the difference between the highest and lowest values, is not more than 10% of the highest value. For example, the lowest value may be 90% of the highest value, or may be at least 91% of the highest value, or at least 92% of the highest value, or at least 93% of the highest value, or at least 94% of the highest value, or at least 95% of the highest value, or at least 96% of the highest value, or at least 97% of the highest value, or at least 98% of the highest value, or at least 99% of the highest value.

Alternatively, the optical transmission profile for a sample may be specified as comprising highest and lowest values which differ by no more than 5% of an average optical transmission value for the profile, where the average may be calculated, for example, from all values included in the profile, or from a subset of values included in the profile, or from all values available for the sample or from a subset of all values available (where the profile may or may not include all available values). Other averages may be used in other embodiments. For example, the highest and lowest values may differ by no more than 4% of the average, or by no more than 3% of the average, or by no more than 2% of the average, or by no more than 1% of the average.

Individual heating elements or portions of material appropriately sized for processing into individual heating elements which have already been separated from a larger sheet of material may have an optical transmission specification falling within these definitions. Also, regions of a larger sheet of material that have an appropriate optical transmission profile, for example according to the above definitions, may be identified as areas from which individual heating elements with suitable resistance values can be formed.

Figure 2:
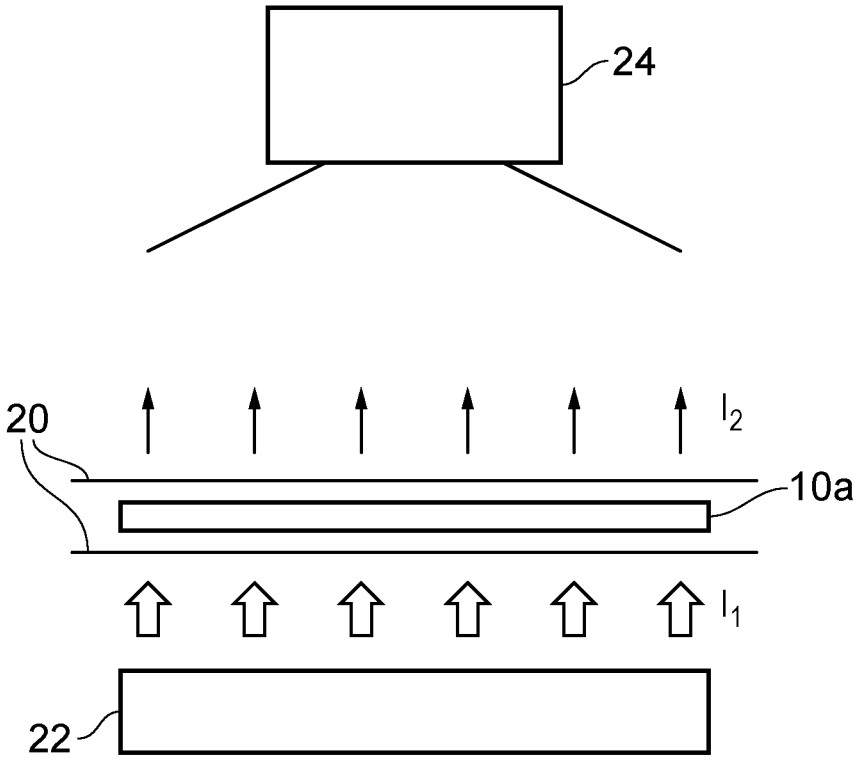
FIG. 2 shows a schematic side view of example apparatus suitable for carrying out methods according to embodiments.

FIG. 2 shows a schematic representation of example apparatus suitable for measuring optical transmission of a sheet of porous conductive material. The apparatus comprises an optical (light) source, an optical (light detector), and a means to arrange a sample for measurement between the source and the detector. More specifically, in this example a sample 10*a* of heating element material (already configured as a single heater 10, or a larger sheet) is placed in position for measurement. Results may be enhanced if the sample is held in a flat position generally perpendicular to the incident light, so if the sample shows some curling, wrinkling or other deformation (such as if it has been cut from a roll of material), it may be placed between two sheets 20 of clear plastic or glass, and secured by clamping. The sheets can be chosen to minimize optical loss through them, such as with reference to the optical characteristics of the sheet material for the wavelength of light emitted from the source 22, and/or by using very thin material. In this way, the proportion of the optical change arising from transmission through the heating element sample 10 is maximized, to improve resolution of the test.

The sample 10*a* is placed over a light source 22, which emits light at a first intensity I1 which is incident on the lower side of the sample 10*a*. The sample 10*a* occupies a finite area (i.e. it is not a point) and to record an optical transmission profile it is necessary to obtain transmission values at a plurality of locations across the sample 10*a*. The apparatus of FIG. 2 is configured to enable this in a single measurement, in that the whole area of interest can be exposed to the light from the light source 22 in a single exposure. Note that the area of interest may be the whole area of the sample 10*a* if it has already been cut, and possibly shaped, into the required dimensions for a completed heating element, or may be a smaller portion within the sample area if the sample is large and intended to be cut into individual heating element parts. To achieve this extensive spatial exposure the light source can be an area light source or a bar light source, capable of producing light of roughly the same intensity over an area at least as large as the area of the sample to be measured (the area of interest). Alternatively, one could employ a point light source with lenses to expand the optical field and flatten the intensity profile across the field. The light may be of any wavelength, as desired, and in particular can be of a single wavelength or may be a broad spectrum or white light source.

On the opposite side of the sample 10 from the light source 22 there is arranged a camera or other light detector 24. The detector 24 may comprise an array of point detectors, for example, such as a CCD array. The aim is to detect light passing from the source 22 through all parts of the sample 10*a* within the area of interest, so the detector area should be appropriately sized. Also, the detector 24 should be configured for detection of the particular wavelength or wavelengths of light emitted from the source 22. In other words, the detector 24 can have high sensitivity to the wavelength of the source 22.

Although the example shows the source 22 under the sample 10*a*, with the detector 24 above, the opposite configuration may be used so that light is directed downwardly through the sample from source to detector, or arranged in a more horizontal configuration. If the apparatus is incorporated into a production line for automated analysis of heating elements being delivered for inclusion into electronic cigarettes, the configuration of the production line and the mechanism used to deliver and remove samples to and from the apparatus may determine the arrangement of the components. Also it may be desired to enclose or partly enclose the apparatus to exclude stray light from the measurements.

In use, the source 22 directs a roughly uniform field of light at intensity I1 onto the sample 10*a*. If the sample 10*a* is an individual heating element or a pre-cut blank to be formed into an individual element, the light field as it impinges on the sample may be roughly at least the same area as the heating element, so that all parts of the sample are illuminated. If the sample 10*a* is a sheet from which individual heating elements are to be separated, a part of the sheet only may be illuminated, for example corresponding to the area of a single heating element. In the former case, analysis of the optical transmission can allows a heating element to be accepted or rejected for use in a vapor provision system. In the latter case, the analysis can indicate whether a particular area of a sheet of material is suitable to be separated for use as a heating element.

The incident light field at intensity I1 impinges on the sample 10*a*, and part of the light is transmitted through the sample (with part being reflected and diffracted and part being absorbed), giving a reduced intensity I2 on the far side of the sample 10*a*. This light is detected by the detector 24, such as by photographing the illuminated sample 10*a* if the detector 24 is a camera. The optical transmission of the sample is I2/I1, being the fraction of incident light which is transmitted. For a fixed apparatus with constant optical output, I1 remains the same for every sample, so an absolute measurement of I2 is equivalent to the optical transmission. If the detector remains the same with fixed detection capability, the measured I2 for different samples may be compared directly to determine variation between samples. For the present proposal, in which variation across an individual sample is of interest, this consistency of apparatus and measurement conditions is less relevant, but may nevertheless aid accuracy.

Experiments (such as described further below) have shown that there is a linear relationship between measured transmitted light intensity and sample resistance (for a given testing configuration).

Figure 3:
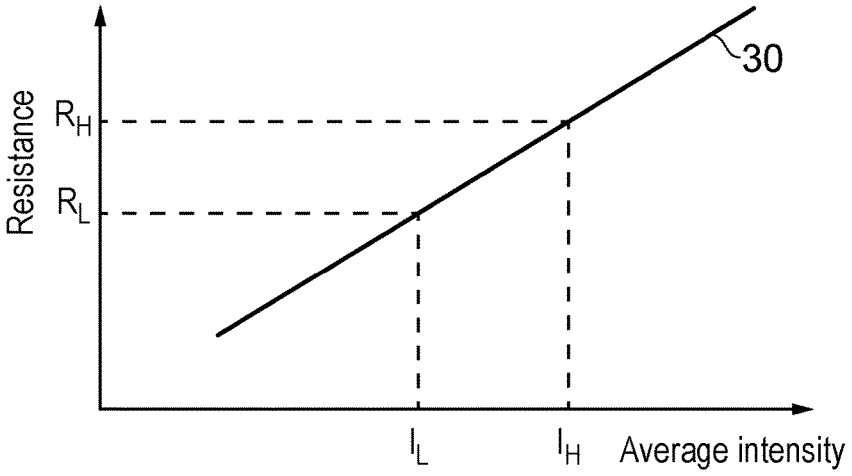
FIG. 3 shows a graph of an example relationship between optical transmission and electrical resistance.

FIG. 3 shows an example graph of a relationship between transmitted intensity and resistance. The line 30 shows a linear proportional relationship, of the form R=aI+b, where R is resistance and I is the measured (average) intensity. Heating element material with a higher resistivity transmits a higher proportion of incident light, so that intensity measured on the far side of a sample is higher. For a particular model or design of electronic cigarette, the heating element can be determined in advance to require a resistivity between a first value $R_L$ and a second higher value $R_H$ (for example, assuming a range of resistivities can be tolerated). An optical transmission measurement can be made on a sample heating element, and if the measured intensity falls between a first value $I_L$ and a second higher value corresponding respectively to the resistance values $R_L$ and $R_H$ as determined from the relationship represented by the graph of FIG. 3, it can be readily ascertained that the sample is suitable for use in the electronic cigarette. An intensity value below $I_L$ or above $I_H$ indicates that the resistivity is too low or too high (i.e. outside the range of $R_L$ to $R_H$), and the sample can be rejected. This graph also demonstrates how optical transmission variability across a single sample can be used to assess the level of homogeneity of electrical resistance, since the correlation between transmission and the resistance is clear.

Using apparatus such as the FIG. 2 example, the transmitted light is measured across the area of the sample, and the measurement is made with a degree of spatial resolution such as is obtainable using a camera or other array of detectors such as a CCD array. While the graph of FIG. 3 shows the relationship between average intensity and resistance, where the average intensity for a sample is derived by averaging individual values within the spatially resolved measurement data obtained for a sample, assessment of optical transmission as proposed herein utilizes the resolved data to obtain an optical transmission profile.

Experiments have been carried out to demonstrate the proposal herein, which showed that there is a clear correlation between the resistance of a sample of porous sheet material suitable for use as an electrical heating element and its optical transmission, indicated by the proportion of light that passes through the sample. This relationship may be used to assess the resistance consistency of a sample by analysis of the optical transmission profile, indicating that optical transmission with a variation within specified limits is a valuable characteristic of such material. Knowledge of optical transmission profiles can enable the rejection of sections of material which are not expected to yield components operating within a required tolerance for resistive heating. This can reduce the number of products which require rejection late in the production process by permitting earlier rejection of faulty or defective material.

In the experiments, the apparatus was configured to backlight samples of material by placing the sample over a light source and directing light upwards through the sample, as in the FIG. 2 example. A 1 megapixel digital camera was used as the light detector, having a 22.5 mm variable focus lens; this was deemed to provide ample resolution. A bar light was chosen as the light source, since it was considered to provide a higher output intensity than an available area light, and a flatter lighting field than a spot light. Bar lights of three wavelengths were investigated to determine if the color of the illumination affected the quality of the information obtainable. Comparing the gain and range between the highest and lowest intensity levels in images taken of backlit samples, and the uniformity of light produced by the source, resulted in selection of a red light over a green light and an infrared light. The infrared light showed low intensity range and gain; the green and red lights were much better in these regards, with the green light showing consistently high gain. However, many cameras have higher sensitivity to red light, so the red light source was chosen for the experiments. Red light is typically defined as having a wavelength in the range of about 620 to 720 nm.

To obtain initial images in the experiments, samples of Bekipor® material (described above), which were cut to a size of 45 mm by 45 mm, were held between two sheets of clear plastic to keep them flat during imaging. The sample was held at 30 mm from the light source, and the camera positioned at 160 mm from the sample, following some testing to determine spacings for good image quality. Varying the spacings was found to have little effect on image quality, so the distances were chosen to give an appropriate field of view for the size of the samples.

Once these parameters for the apparatus were established, images of samples were taken with the camera, and processed to provide a format from which useful intensity information could be extracted.

FIG. 4 shows the results of some of this imaging. An inspection program was developed to collect the raw image data (photograph) captured by the camera into regions to each of which an intensity value is attributed, so that the data could be displayed as a 2D intensity contour map to highlight the different regions of the image. FIGS. 4A and 4B show two examples of raw images, of different samples, and FIGS. 4C and 4D respectively show the corresponding 2D intensity contour maps, where the darker areas are low intensity and the paler areas are high intensity. The light and dark areas in the original images correlate with the various regions in the contour maps. Images of this type were used together with resistance measurements to establish that regions in an image showing a high intensity correspond to parts of the sample having a higher resistance (since less conductive material is present) and regions showing a low intensity correspond to a lower resistance (since more conductive material is present, blocking the incident light from the light source and preventing its transmission to the camera for imaging). The 2D maps can be thought of 2D optical transmission profiles, as described above, since they represent the variation of optical transmission across a sample.

To establish the relationship between optical transmission or intensity and resistance, testing was performed to determine the resistance of some samples. Each sample was in turn held between conductive clamps, and an ohm meter was used to measure the resistance of each sample five times, and an average resistance for each sample was calculated from these measurements. The averaging was intended to take account of any variations in temperature, tension in the clamped samples, and position of the clamps. The samples were a set of one hundred slotted heating elements stamp-cut from sheet Bekipor® material to have a shape like that in the FIG. 1 example.

Figure 4A:
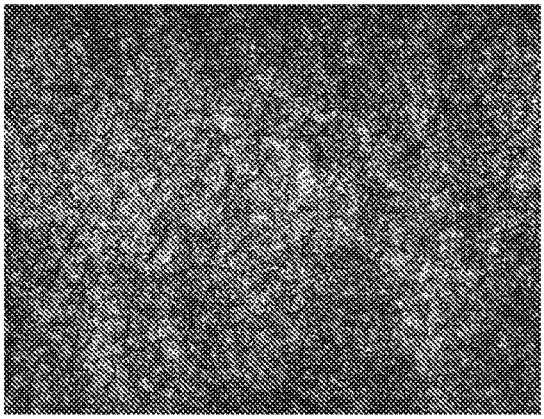
FIG. 4 shows images of porous conductive sheet material (FIGS. 4A and 4B) and corresponding 2D intensity contour maps (optical transmission profiles) derived from the images (FIGS. 4C and 4D).
Figure 4C:
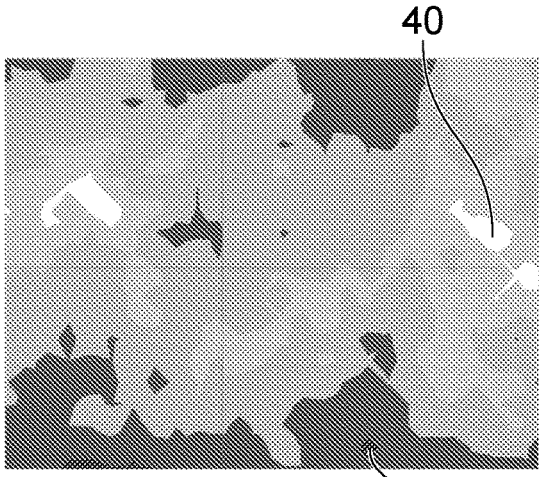
Figure 4B:
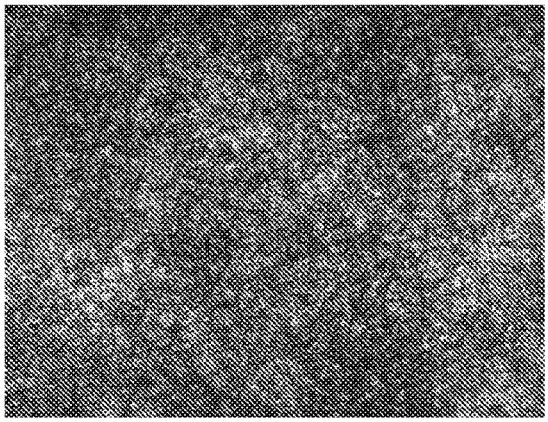
Figure 4D:
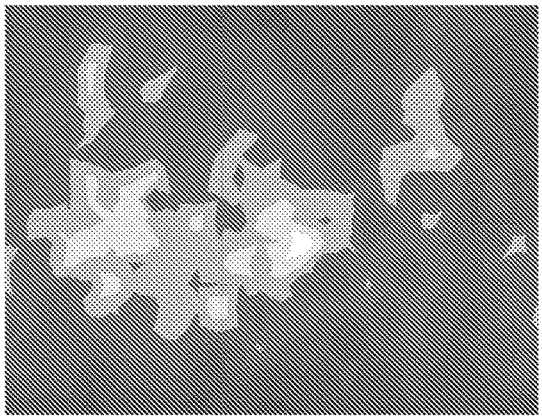

Images were taken of the samples to generate intensity data like the FIGS. 4C and 4D profiles, and used to derive an average intensity value for each sample, being a single numeric value indicating the measured intensity of light transmitted through the finite area of a sample. Various approaches to determining a suitable representative value were considered. The image data was divided into contiguous regions, each having a numerical value indicating the recorded intensity for that area; this gives numerical transmission profile data, and the 2D intensity contour maps such as those in FIG. 4 are graphical representations of this type of data. Different averaging methods involve the selection of different sets of values to be averaged, such as the full area of the sample, or different groups of values intended to model the parts of the sample where the current path used in resistive heating will likely pass. The averaging resulted in a single intensity value per sample which could then be directly plotted against the average resistance values. For the one hundred samples, the averaging used data lying in a path chosen to model the actual serpentine current flow that occurs in a slotted heating element. Thermal images of a heating element with an applied current of 1 A were examined to establish the shape and size of the current path to be modeled.

Figure 5:
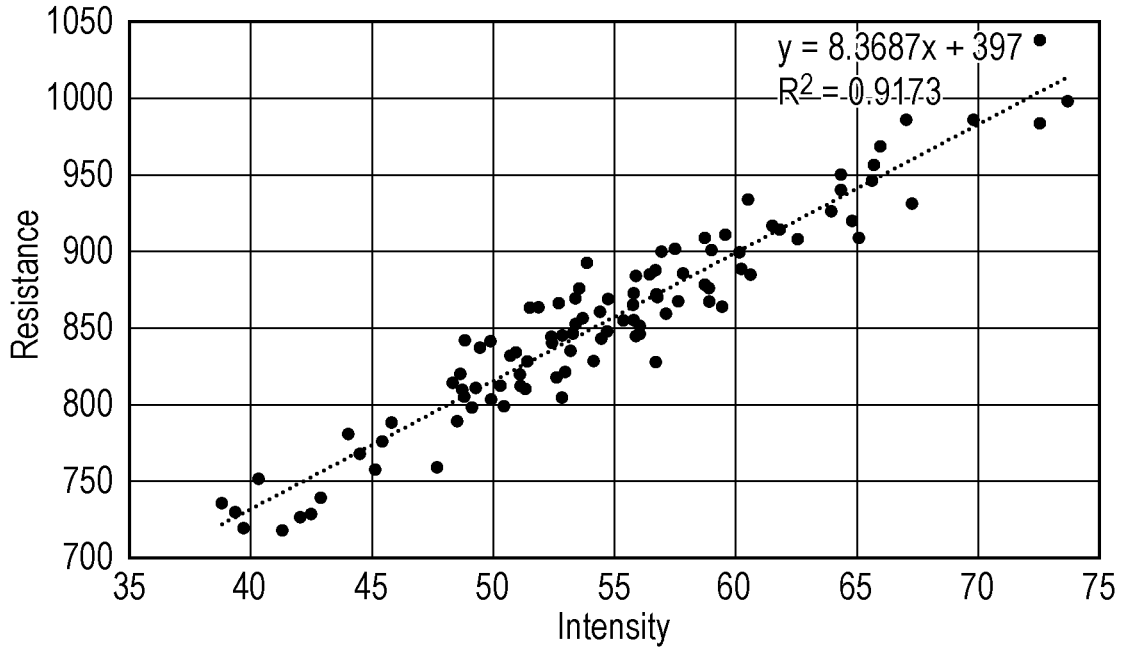
FIG. 5 shows a scatter graph of measured average intensity values against measured electrical resistance for multiple sample heating elements.

FIG. 5 shows a graph of the intensity values plotted against the resistance values for these one hundred samples, to which a straight line has been fitted. The data has an $R^2$ value of 0.9173, where $R^2$ is the usual statistical measure of how close data lie to their fitted line. This is a high value (since $R^2$ can have a maximum value of 1), from which we can deduce that the proportional relationship between intensity and resistance is valid. Hence the proposed use of optical transmission profiles as a characteristic to specify planar conductive porous material is sound.

Since the relationship between optical transmission (or measured transmitted intensity) and resistance is proven, we consider analysis of the optical profile as a credible indicator of the resistance variability within a sample of material.

As described above, an optical transmission profile is defined as a set of transmission measurements (values) spatially distributed across a sample (in one or two dimensions), and the magnitude of the difference between the highest and lowest values is indicative of the spatial variation of electrical resistance within the sample, arising from any inhomogeneities in the physical structure of the sample material. Hence, we can analysis a profile to determine the magnitude of the difference (where the difference between the highest and lowest values is also known as the range). Additionally, this can be compared against a pre-specified acceptable maximum value for the range to determine whether a sample is suitable for use as a heating element, in that it can be expected to perform as required for heating. The acceptable maximum value for the range might be derived from the corresponding acceptable variation in resistance, using a relationship such as that shown in the graph of FIG. 5.

Consider the example 2D profile of FIG. 4C. The palest areas, such as area 40, correspond to the maximum measured transmitted light intensity and the darkest areas, such as area 42, correspond to the minimum measured transmitted light intensity. Area 40 (and other areas of the same shade) has a corresponding numerical value indicating the amount of light detected in that area; let us designate this as H, representing the highest measured value. Similarly, area 42 (and other areas of the same shade) has a corresponding numerical value indicating the amount of light detected in that area; let us designate this as L, representing the lowest measured value. The range, or variation, for the profile, being the magnitude of the difference between the highest and lowest values, is therefore H−L (or equivalently, |L−H|).

This range can be used to characterize a sample, and further be used to classify the sample according to whether it is suitable for use as a heating element, for which the range will desirably be at or below a specified threshold corresponding to a maximum tolerable variation in resistivity. If we designate the range from the optical transmission profile as V where V=H−L, and the threshold as T, then a test for V<T can establish that a sample meets the criterion for use as a heating element. If the sample is a pre-cut heating element, it can be passed for incorporation into an electronic cigarette or a component for an electronic cigarette such as an atomizer or a cartomizer. If the sample is a pre-cut blank to be formed into a heating element, it can be passed for further processing into the final form of the heating element. If the sample is a portion of a large sheet of material, the portion can be designated for separation from the sheet and further processing into a heating element.

The range V may be calculated as an absolute value from the actual measured optical transmission. If the threshold is set also as an absolute value, which will be applicable in the case of a specified material type and known measurement conditions (fixed specified apparatus), the two can be directly compared. For more general applicability, we can consider percentage differences or proportions. For example, the minimum value from the optical profile can be required to fall within a particular percentage of the maximum value, such as the minimum value is 90% or more of the maximum value. Conversely, the range can be required to correspond to a particular proportion or percentage of the maximum value or the minimum value, such as the range is no more than 10% of the maximum value or the range does not exceed 10% of the minimum value. Alternatively, the maximum value and the minimum value can be required to fall within a particular percentage of an average optical transmission value for the profile, such as within 5% or less of the average value, or the minimum value is at least 95% of the average value and the maximum value is not more than 105% of the average value.

Note that when producing a 2D profile such as FIG. 4C, it is typical to divide the measured values into contiguous groups of values, each group being a small spread of values within the full spread of data, defined between a maximum and a minimum for that group. A shade or color is assigned to each group, which are then used to generate the map. If the data is in this form, there will be a group of maximum values and a group of minimum values, and a single maximum and a single minimum for the whole data set may not be available. If so, a choice can be made of a representative value from each group to use when determining the range for the profile. For example, one could use the minimum value defined for one group and the maximum value defined for the other group, or the minimum values or maximum values for each group, or a midpoint value for each group. For current purposes, a value such as these examples representing a minimum group and a value representing a maximum group are considered equivalent to an actual minimum value and an actual maximum value for the purpose of assessing and defining the range or variation in an optical transmission profile.

The contour map type of profile in FIG. 4C represents measured transmission data from many closely spaced locations which effectively cover the whole of the sample so that the complete sample surface is mapped. Alternatively, one can use measurements more widely spaced across the sample surface to define the profile; the measurements may be arranged in a regular array, or be randomly spaced and located. Such measurements might be individually acquired with suitably configured apparatus, or might be extracted from a larger set such as from a complete image of the sample like the FIG. 4A photograph.

One may also define or acquire a one-dimensional (1D) optical transmission profile, where a series of optical transmission values (or intensity measurements) are spaced along a line, rather than spread across both the length and width of a sample. The line may or may not be straight. If the data is of this type, the profile can be represented as a line graph, rather than a contour map.

Figure 6:
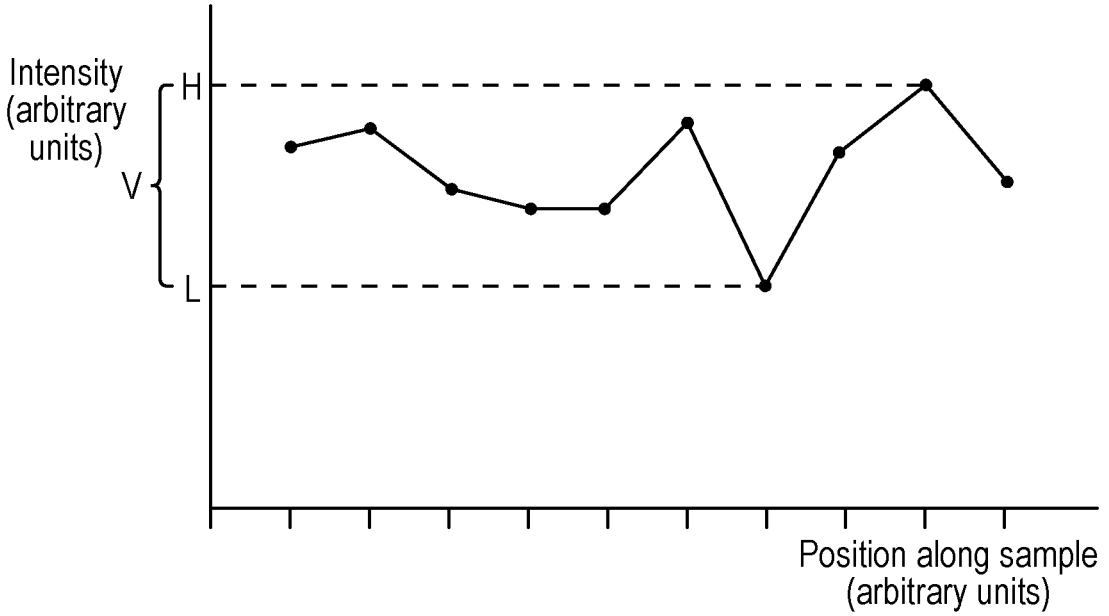
FIG. 6 shows a graph of an example 1D optical transmission profile of a sample of porous conductive sheet material.

FIG. 6 shows an example of an optical transmission profile of a 1D, linear type. For ten evenly spaced positions along the surface of a sample, the transmitted light intensity has been measured. A maximum intensity level of H and a minimum intensity level of L were detected. The difference between these levels is the range or variance V, which can characterize the sample, and be compared with a threshold value to assess the suitability of the sample as described above.

The example profiles of FIGS. 4 and 6 present the optical data in terms of its spatial distribution. In reality, there is no requirement to do this for the present purpose, since we are interested in the maximum and minimum values and these can readily be extracted from a set of measurements without reference to the spatial arrangement. However, the spatial information may be relevant for some purposes.

As noted above, optical transmission data suitable for analysis according to the examples herein can be obtained as a set of individual measurements, rather than extracting separate values from a image or similar data array. In this case, the apparatus can be modified compared with the example of FIG. 2.

Figure 7:
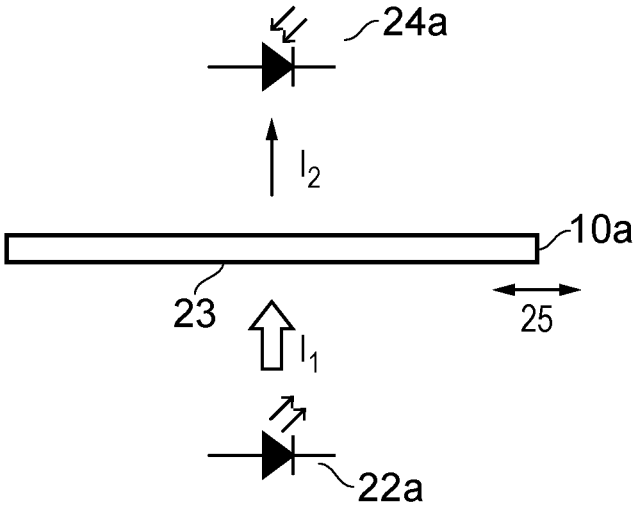
FIG. 7 shows a schematic side view of a further example apparatus suitable for carrying out methods according to embodiments.

FIG. 7 shows a schematic side view of a second example apparatus. As before, a sample 10*a* is held between a light source and a light detector. In this example, however, the light source is effectively a point source, such as a light emitting diode (LED) or a laser 22*a*, and the detector is effectively a point detector (in that it has no spatial resolution), such as a photodiode 24*a*. The LED 22*a* emits a beam of light at first intensity I1 which is arranged to be incident (for example perpendicularly) on a selected location 23 on the surface of the sample 10*a*. Owing to absorption, diffraction and reflection only a portion I2 of the incident light I1 is transmitted through the sample 10*a*, and detected by the detector 24*a*, to give a first transmission/intensity measurement. The sample 10*a* is movably mounted in the measurement position, such as on a translation stage, so that it can be moved in the plane orthogonal to the light propagation direction, as indicated by the arrow 25. Thus, after the first measurement is made, the sample 10*a* can be translated to a new position so that the incident light I1 impinges on a different part of the sample 10*a*, and the transmitted light I2 is detected as a second measurement. In this way, a set of measurements can be acquired to collectively form an optical transmission profile.

Alternative arrangements may be employed to achieve the same effect. For example, the sample 10*a* may be kept stationary and the source 22*a* and the detector 24*a* may be moved between measurement positions. If the source and detector are held on a common stage, they can be conveniently translated together while maintaining their alignment along a common beam axis. They may be separately mounted instead. Also, a point source may be used with a large area detector, in which case translation of the source or the sample will access the required set of measurement locations. Alternatively, a large area source may be used with a point detector, together with translation of the detector or the sample.

Figure 8:
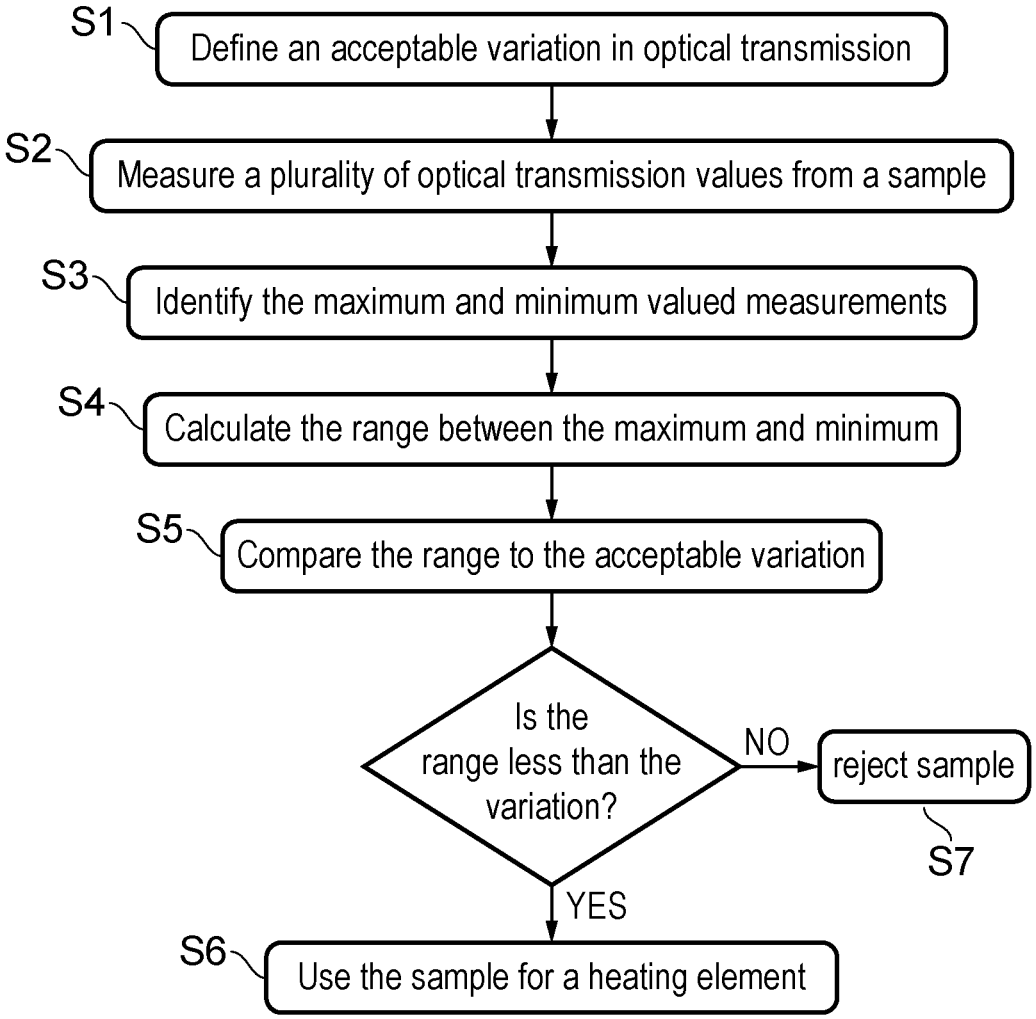
FIG. 8 shows a flow chart of an example method.

FIG. 8 shows a flow chart of an example method of sample analysis according to an example. In 51, an acceptable variation in optical transmission is defined. This may be for a particular design of heating element, formed from a particular material, for example, and may be defined with reference to a resistance/transmission relationship such as that depicted in FIG. 5, by deciding what deviation or variation in resistance can be tolerated and ascertaining the range of optical tolerance to which this variation corresponds. The absolute value of resistance may not be of interest; rather the method is concerned with assessing uniformity or homogeneity of resistance within a sample, so detect there is not too much variation within a single sample. The acceptable variation may be a percentage or proportion of a maximum or minimum optical transmission.

In S2, a plurality of optical transmission values are measured at a plurality of locations on a sample which requires assessment. Apparatus such as that in FIG. 2 or FIG. 7 might be used. The plurality of measurement values form a data set representing an optical transmission profile for the sample, and may be plotted for spatial analysis as in the examples in FIG. 4C, 4D or 6.

Moving on to S3, the maximum and minimum optical transmission values in the data set are identified. In S4, the range for the data set is calculated, being the difference between the maximum and minimum values. This can be in the format of an absolute value of the difference, or as a percentage, proportion or fraction of the maximum or minimum value, depending on the definition used for the acceptable variation.

In S5, the calculated range S4 is compared to the acceptable variation established in S1. If the range is less than the acceptable variation, the method moves to S6 in which the sample is used as, or to fabricate, a heating element such as for an electronic vapor provision system. If the range is greater than the acceptable variation, the sample is rejected for such use, in S7.

As an example, the acceptable variation might be predetermined or defined to be 8% of the maximum measured optical transmission. If the range calculated from the maximum and minimum measurements is 8% of the maximum or less, the sample can be passed as fit for use.

In an alternative, the acceptable variation can be defined in S1 in terms of a difference from (or percentage, proportion or fraction of) an average value, instead of a range between maximum and minimum values. In such a case, S4 of the method becomes a step in which an average value of optical transmission is calculated from the values measured in S2, and the difference (or deviation or variance) of the maximum and/or the minimum values from this average is calculated. In S5, the comparison is a comparison of this difference with the acceptable variation.

As an example, the acceptable variation might be predetermined or defined to be 3% of the average measured optical transmission. If the maximum measured value differs from the average by no more than 3% of the average and/or the minimum measured value differs from the average by no more than 3% of the average, the sample can be passed as fit for use.

In a further alternative, the acceptable variation can be defined in S1 as requiring the minimum value to be at least a certain percentage, proportion or fraction of the maximum value (or vice versa). Then, S4 becomes a calculation in which the minimum and maximum values are compared to determined the percentage, proportion or fraction of the maximum value which the minimum value comprises, and in S5 the comparison is to compare this calculated percentage, proportion or fraction with the acceptable variation. The comparison is passed if the calculated percentage, proportion or fraction is not less than the defined acceptable variation.

As an example, the acceptable variation might be predetermined or defined to be 95% of the maximum measured optical transmission. If the measured minimum value is 95% or more of the measured maximum value, the sample can be passed as fit for use.

In these various examples, the value or values calculated or derived from the maximum value and minimum value (either the range of the profile, the deviation of the maximum and/or minimum from the average, or the proportion of the maximum represented by the minimum) can be considered as a difference value, which is a value calculated from the maximum and minimum values in an optical transmission profile and indicative of the variation of optical transmission values recorded for a sample.

Thus far the proposals herein have been discussed in the context of heating elements intended to operate by resistive heating in which a heating element is connected to an electrical power source so that current flows through the heating element, and electrical resistance of the heating element material causes the current flow to generate heat. This can be referred to as ohmic heating or Joule heating, using the passage of a current through a conductive heating element, the current being delivered from an external power supply such as a battery in the electronic cigarette. The amount of heat generated depends on the resistance of the heating element, so use of a heating element with appropriate resistive properties is important.

As an alternative, it is possible to use induction (inductive) heating to generate heat in a heating element within an electronic cigarette. Induction heating is a phenomenon that allows heating of an electrically conductive item, typically made from metal, by electromagnetic induction. An electronic oscillator is provided to generate a high frequency alternating current that is passed through an electromagnet. In turn, the electromagnet produces a rapidly alternating magnetic field, which is arranged to penetrate the object to be heated, in this case a heating element made from a conductive porous sheet material. The magnetic field generates eddy currents in the conductive material, and this flowing current generates heat via the resistance of the material. Hence, induction heating also requires current flow to generate heat from a material's electrical resistance, but the current is an eddy current generated by an external magnetic field, rather than a current obtained by a potential difference applied from an electrical power supply. The material for the heating element is required to have appropriate resistive properties, as before.

Accordingly, examples of the proposed herein are applicable to heating elements and material therefore, and the analysis/characterization thereof, which are intended to be used with an induction heating arrangement in an electronic cigarette. For a given induction heating design, a particular resistance or range of resistance will be required, so heating elements may be assessed for compliance using optical analysis as described herein. Also, heating elements characterized by their optical transmission properties, as reflecting homogeneity of structure and resistance, are relevant to induction heating arrangements.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A method for obtaining a heating element for an electronic vapor provision system, the method comprising:

providing a sheet of electrically conductive porous material;

measuring amounts of light transmitted through at least two locations on the sheet to obtain a set of optical transmission values including a maximum value and a minimum value;

comparing a difference value calculated from the maximum value and the minimum value with a predetermined acceptable variation in optical transmission; and selecting the sheet for use as a heating element if the difference value falls within the predetermined acceptable variation.

2. The method according to claim 1, wherein the difference value is the difference between the maximum value and the minimum value, and the predetermined acceptable variation is a largest acceptable range in the measured optical transmission values which the difference value should not exceed.

3. The method according to claim 2, wherein the difference value is expressed as a percentage, proportion or fraction, and the largest acceptable range is defined as a percentage, proportion or fraction of the maximum value or the minimum value of optical transmission measured for the sheet.

4. The method according to claim 3, wherein the largest acceptable range is not greater than 10% of the maximum value.

5. The method according to claim 1, wherein the difference value is at least one of a difference between the maximum value or the minimum value and an average value of the set of optical transmission values, and the predetermined acceptable variation is a largest acceptable deviation of the maximum value and/or the minimum value from the average value which the difference value should not exceed.

6. The method according to claim 5, in which the difference value is expressed as a percentage, proportion or fraction, and the largest acceptable deviation is defined as a percentage, proportion or fraction of the average value of the set of optical transmission values measured for the sheet.

7. The method according to claim 6, wherein the largest acceptable deviation is not greater than 5% of the average value.

8. The method according to claim 1, wherein the difference value is the percentage, proportion or fraction of the maximum value represented by the minimum value, and the predetermined acceptable variation is a minimum acceptable value of the percentage, proportion or fraction.

9. The method according to claim 8, wherein the minimum acceptable value is at least 90% of the maximum value.

10. The method according to claim 1, wherein the electrically conductive porous material comprises a mesh of metal fibers.

11. The method according to claim 10, wherein the mesh of metal fibers comprises a mesh of sintered stainless steel fibers.

12. The method according to claim 1, further comprising determining the acceptable variation in optical transmission using a known relationship between optical transmission and electrical resistance for the electrically conductive porous material.

* * * * *